United States Patent [19]

Jackson et al.

[11] 4,280,664

[45] Jul. 28, 1981

[54] SOLIDS REDUCING AND MIXING DEVICE

[76] Inventors: Jerald A. Jackson, 2204 Cherry Ridge, Pine Bluff, Ark. 71603; John W. Holcomb, P.O. Box 116, Star City, Ark. 71667

[21] Appl. No.: 34,923

[22] Filed: Apr. 30, 1979

[51] Int. Cl.[3] ..... B02C 19/06

[52] U.S. Cl. ..... 241/39; 241/5; 241/40

[58] Field of Search ..... 241/5, 39, 40, 46.04, 241/62, 46 B, 24

[56] References Cited

U.S. PATENT DOCUMENTS

| | | | |
|---|---|---|---|
| 2,054,280 | 9/1936 | Brown | 241/40 X |
| 3,075,710 | 1/1963 | Feld et al. | 241/24 X |
| 3,741,485 | 6/1973 | Gage et al. | 241/5 X |
| 4,059,231 | 11/1977 | Neu | 241/5 |

*Primary Examiner*—Mark Rosenbaum

*Attorney, Agent, or Firm*—Harvey B. Jacobson

[57] ABSTRACT

Fluid material having solids entrained therein is injected under high pressure through a nozzle disposed tangentially of a cylindrical housing. Groups of impactors are spaced circumferentially about the housing interior and include multiple rows with adjacent rows being staggered. The solid material strikes the impactors thereby reducing the size of the material. The fluid carries the solids circularly around the housing with the solids gaining speed between groups of impactors. The housing has an axially positioned discharge chute which is vertically disposed and adjustable in height. The mixture circulates through the housing in a vortex pattern, and exits through the axial discharge. The heavier solids are urged radially outward under centrifugal force and constantly strike the impactors until their size is reduced sufficiently to allow them to follow the mixture through the axial discharge.

8 Claims, 4 Drawing Figures

SOLIDS REDUCING AND MIXING DEVICE

BACKGROUND OF THE INVENTION

1. Field of the Invention

This invention relates to an apparatus for grinding solid materials entrained in the liquid stream for forming slurry, slush, pulp or colloidal mixes.

2. Discussion of Related Art

Many devices for comminuting frangible materials have been suggested. Of these, one group has come to be known as anvil mills. Such mills include means for accelerating coarse particles to a high velocity, at which time the particles are allowed to impact against each other or against anvil-like members in order to substantially reduce the size thereof. One example of such a device is shown in U.S. Pat. No. 2,562,753, issued July 31, 1951 to Trost. The Trost device includes a circular housing encompassing a plurality of wedge-shaped restrictors. The restrictors are placed within the radial outer portion of the grinding chamber, each adjacent to a jet of energizing fluid and placed such that the outer portion of the circulating fluid and the larger particles contained therein will be diverted by said restrictors toward the peripheral wall of the chamber. U.S. Pat. No. 3,688,991, issued Sept. 5, 1972 to Andrews, shows a jet and anvil comminuting apparatus which includes a jet which accelerates particles entrained gas into a chamber having a rotating wheel connected to a plurality of anvils which anvils cross the path of the injection jet at a rate of several hundred anvils per second. U.S. Pat. No. 3,741,485, issued June 26, 1973 to Gage et al, shows a grinder for increasing the bulk density of finely divided materials. The Gage et al device includes a cylindrical grinding chamber having a tangential input nozzle and a centrally located fluid exit tube. Particle size reduction is effected by contact of the particles with one another and with the sides of the grinding chamber. Centrifugal force holds the larger particles toward the outside of the chamber while the smaller particles tend toward the center of the chamber and exit over the top of the centrally located exit tube. Retention time of the ground product may be regulated by changing the height of the exit tube. U.S. Pat. No. 4,059,231, issued Nov. 22, 1977 to Neu, shows an apparatus for selectively comminuting particles of a frangible material. The Neu device includes an essentially linear housing having a plurality of rows of impactors disposed thereacross. The adjacent rows of impactors are staggered for providing a tortuous route for particles thereby insuring contact of some of the particles with certain of the impactors.

SUMMARY OF THE INVENTION

The present invention includes a substantially cylindrical housing the interior of which defines a particle reduction chamber. The housing has a bottom fixed thereto and a removable top attached to it. An inlet is attached tangentially to the housing and accepts a removable nozzle. Through the housing bottom is disposed an opening through which extends an axial discharge port. The discharge port is axially movable within the housing. Four groups of impactors are contained within the housing and are spaced about the periphery of the reduction chamber. Each group contains a plurality of impactors which are formed into rows with adjacent circumferentially spaced rows being offset in order that particles to be disintegrated cannot easily find a path between the impactors. The mixture of fluid and solid particles is forced through the nozzle and accelerated to a high speed. The mixture flows in a circular movement in the reduction chamber. Centrifugal force acts on the mixture to cause the heavier particles to migrate to the outside of the circulating mixture and strike the impactors. The spacing between the groups of impactors allows the particles to regain speed and momentum before contacting the next group of impactors. The smaller particles migrate to the center of the chamber where they enter the vertical discharge tube and are discharged out the bottom of the device.

Accordingly, one object of the present invention is to provide a novel device which can both reduce the particle size of solids and cause mixing of the reduced particles with liquid.

A further object of the present invention is to provide a novel device for providing solids reduction and mixing which reduces the solids by forcing them to strike against impactors.

A still further object of the present invention is to provide a solids reducing and mixing device wherein the impactors are positioned in spaced groups to allow particles to regain high speeds when traveling between the groups.

An even still further object of the present invention is to provide a novel solids reducing and mixing device which uses centrifugal force to classify solids by size, allowing the smaller sized particles to exit through a central discharge opening.

One additional object of the present invention is to provide a centrally located discharge opening which is adjustable in vertical height for controlling the size of particles allowed to exit from the device.

One more even still further object of the present invention is to provide a novel solids reducing and mixing device which is composed of a plurality of separable elements in order that the various components may be easily replaced for accommodating various mixtures and providing for the replacement of worn parts.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
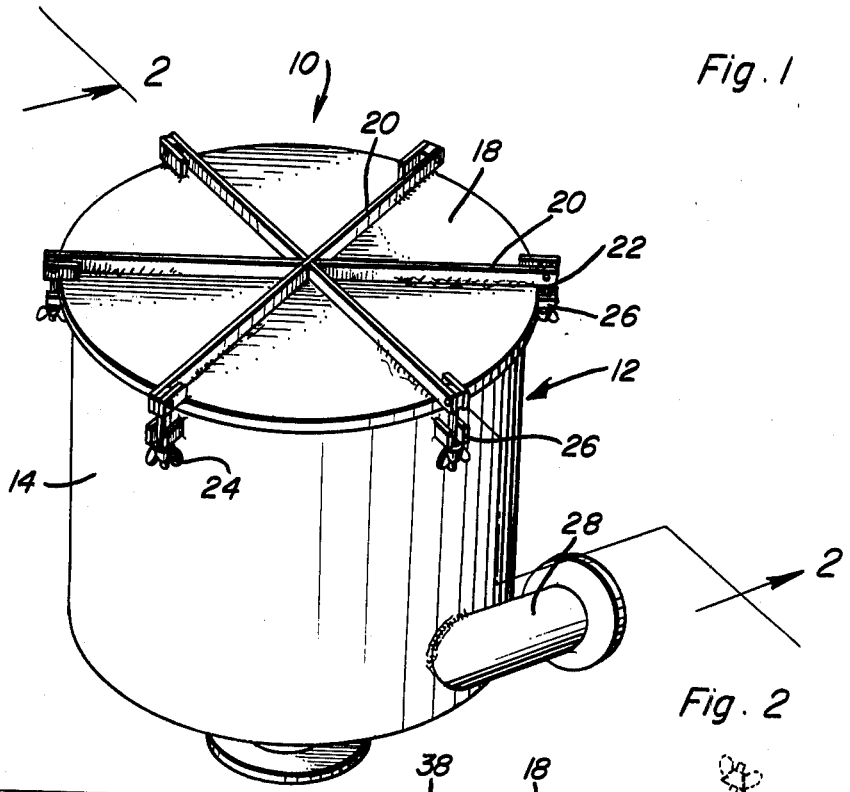
FIG. 1 is a perspective view of the solids reducing and mixing device of the present invention.
Figure 2:
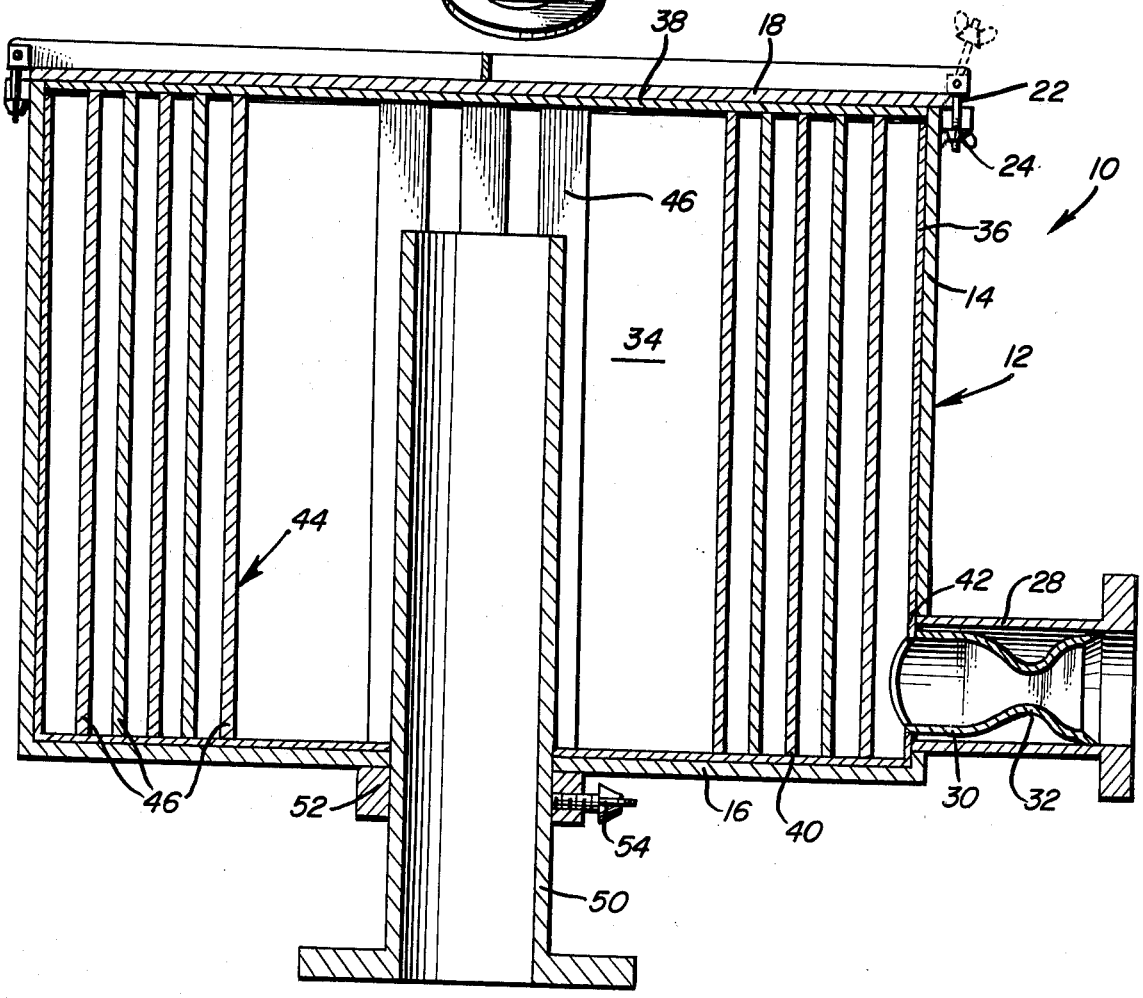
FIG. 2 is an elevational view sectional view taken substantially along a plane passing through section line 2—2 of FIG. 1.
Figure 3:
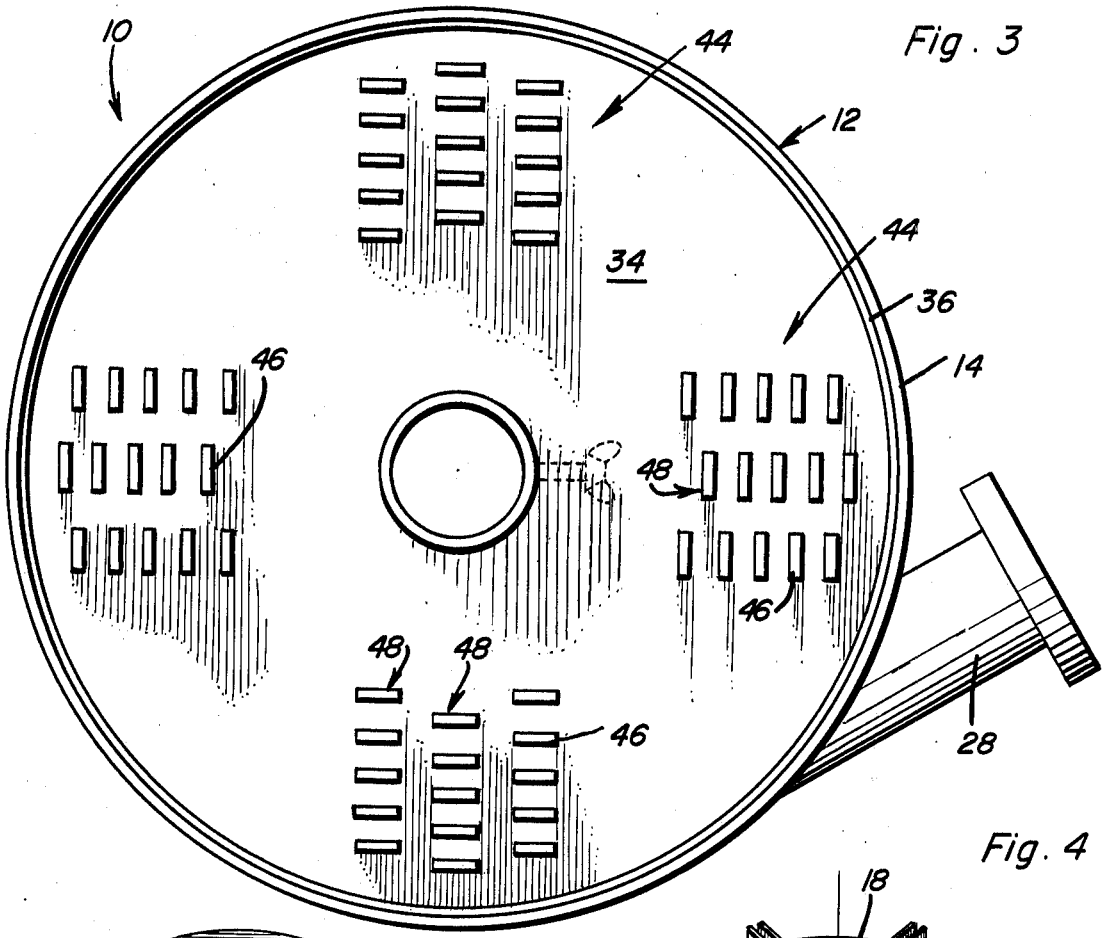
FIG. 3 is a top plane view of the solids reducing device with the cover removed.
Figure 4:
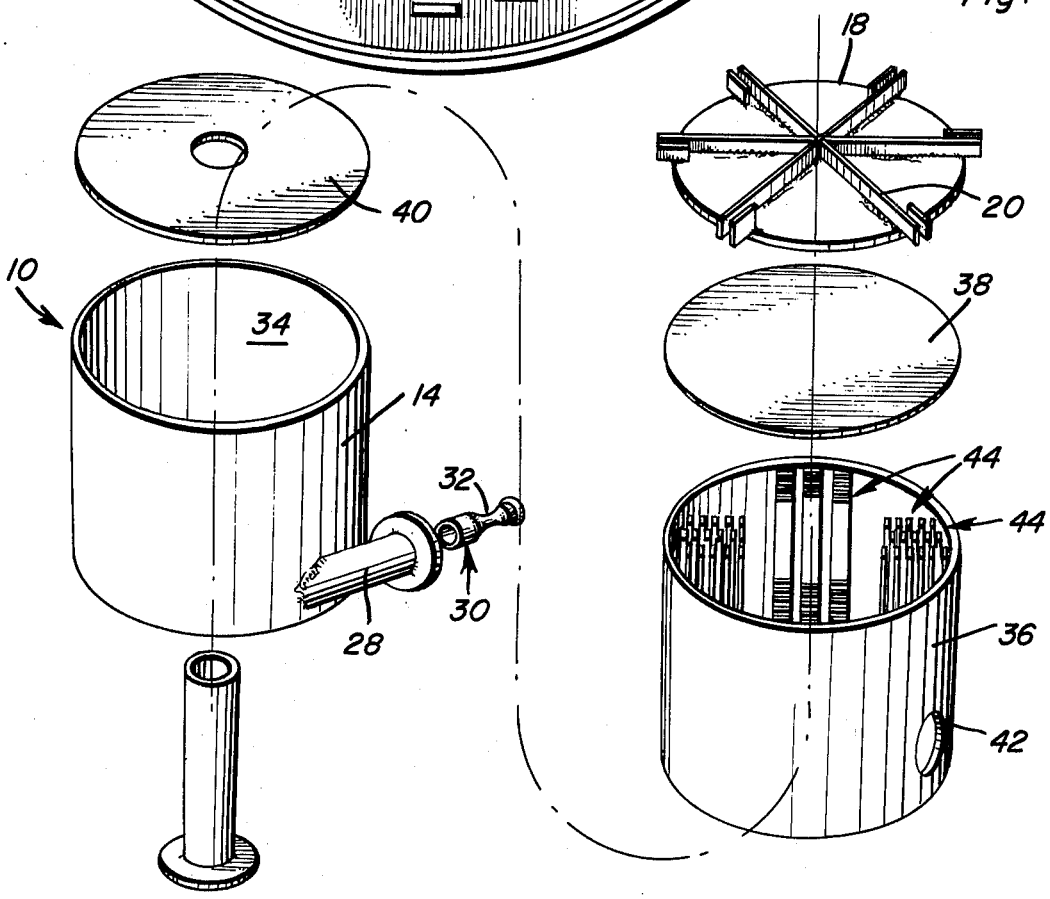
FIG. 4 is an exploded view of the solids reducing and mixing device.

Now with reference to the drawings, a solids reducing and mixing device, generally referred to by the reference numeral 10, which is constructed in accordance with the principles of the present invention will be described in detail. It can be clearly seen that the device 10 includes a housing 12 which constitutes a cylindrical wall 14 attached to a fixed bottom 16 and a removable top 18. The top 18 includes a plurality of radially extending support bars 20 which have threaded connectors 22 attached to the ends thereof. Each threaded connector 22 has a wing nut 24 which fits below a pair of laterally extending bosses 26 which project outwardly from the cylindrical wall 14. The wing nuts can be tightened to provide as tight a seal between the top and wall 14 as is desired.

An inlet 28 is attached to the cylindrical wall 14 and extends tangentially away from that wall. A nozzle 30 is removably inserted into the inlet. The nozzle 30 contains an axially aligned venturi 32 which provides the desired acceleration of the material being introduced into the interior of the housing 12. The inlet, and the venturi, are connected to a source of fluid and solids mixture comprising, for example, water, chemicals and solid lumps, pellets, nodules, flakes or kernels. The pressurized mixture is introduced into the nozzle and accelerated to a speed of 60–110 miles per hour by the venturi. Of course, the nozzle can be removed and replaced with nozzles having various sized venturi for providing the appropriate acceleration to the mixture.

The housing 12 defines an interior reducing chamber 34 into which the solids and liquid mixture is introduced through inlet 28. Contained within the reducing chamber is a liner comprising cylindrical liner section 36, liner top 38 and liner bottom 40. The cylindrical liner section 36 contains an aperture 42 which is aligned with inlet 28 for permitting the introduction of the mixture into the reducing chamber. The liner is held within the housing by pressure from the housing top 18 as applied through the connectors 22. The liner bottom rests on the housing bottom while the liner cylindrical section rests on the liner bottom and the liner top rests on the liner cylindrical section and is forced thereagainst by the housing top. The frictional engagement of these elements is produced through the pressure of the housing top on the liner top and the liner is forced together and held as a unit.

Four groups of clusters 44 of substantially rectangular impactors 46 are fixedly attached to the liner bottom 40 and extend vertically upward therefrom. The clusters 44 are spaced at equal intervals about the outer periphery of chamber 34 in order that partially reduced particles which contact and are slowed down by first cluster 44 will be afforded time to be accelerated to the desired impact speed before contacting the next group of clusters. Furthermore, in the space provided between the clusters, the particles can collide with one another and become randomly distributed throughout the liquid. The clusters are disposed about the outer periphery of the chamber 34 since the incoming mixture will circulate through the chamber at a high rate of speed thus producing centrifugal forces which act on the heavier particles causing them to migrate to the outside of the chamber. Accordingly, the heavier particles are the ones which collide with the impactors producing the desired reduction. The smaller particles migrate toward center of the chamber. Thus the positioning of the impactors within the chamber serve to provide a classification function since once the particles become small enough to migrate radially inward past the inner extent of the impactors, the reduction process with respect to these particles will cease.

Each cluster 44 is divided into rows 48 which are disposed parallel to one another with each circumferentially adjacent row within the chamber being offset in order to maximize the number of impacts made by the particles by preventing channeling between the impactors. The forward rows serve to reflect impacting material back into the next offset row of impactors.

The lighter material which migrates toward the center of the reducing chamber 34 surmounts outlet tube 50 and exits through the bottom thereof. The outlet tube 50 extends through openings in both the housing bottom 16 and the liner bottom 40 and upwardly into the chamber 34. A collar 52 is connected to the housing bottom and includes a set screw 54 which holds the adjustable outlet tube at a predetermined height.

In operation, the pressurized fluid and solids mixture is introduced through inlet 28 and nozzle 30 tangentially into the reducing chamber 34 at a speed of from 60–110 miles per hour. The mixture contacts the first cluster of impactors, which are spaced from the inlet to allow acceleration of the particles. The particles are reduced in size by contact with the impactors and the mixture continues to circulate through the chamber with the larger particles migrating toward the outside and the lighter particles migrating toward the middle of the chamber and exiting through outlet tube 50. The larger particles increase in speed when traveling between the clusters and strike the individual impactors causing further particle reduction. The process continues until the particles are reduced in size sufficiently for them to migrate inwardly and exit through the outlet tube.

By proper selection of impactors, venturi and outlet height, the solids reducing and mixing device can be used with a weight scale, liquid pump and mixed prepartion vat to produce milled products for use in food, chemical, soap or agricultural product industries. The mill is constructed of stainless steel and includes replaceable liner and nozzle and therefore is conceptionally adaptable to any product requirement, unit size being a function of the desired solid particle size and the mixed volume.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A solids reducing and mixing apparatus comprising in combination:

a housing defining a generally cylindrical reducing chamber therein;

an inlet tangentially attached to said housing for introducing a solids and fluid mixture into said chamber;

stationary impactors arranged in clusters within said cylindrical chamber, a plurality of said clusters being disposed in spaced relation about an outer peripheral portion of said reducing chamber; and an outlet tube disposed centrally of said reducing chamber and extending axially out of said housing for providing an exit for a combined solids and fluid mixture, wherein a radially inner portion of said reducing chamber surrounding said outlet tube is free from obstruction.

2. The apparatus of claim 1 and further including a liner having a bottom portion removably overlaying a bottom of said housing, said clusters being fixedly attached to said liner bottom portion, said clusters and liner bottom portion being easily removed for allowing replacement thereof.

3. The apparatus of claim 2 wherein said inlet has a nozzle removably inserted therein, said nozzle having a venturi axially aligned therewith for providing acceleration to the said solids and fluid mixture.

4. The apparatus of claim 2 wherein said liner further includes a liner wall disposed adjacent said cylindrical housing within said cylindrical chamber.

5. The apparatus of claim 4 wherein said liner further includes a liner top resting upon said cylindrical liner wall.

6. The apparatus of claim 1 wherein each of said impactors is an elongated, substantially rectangular member disposed axially of said housing.

7. A solids reducing and mixing apparatus comprising in combination:

a housing defining a generally cylindrical reducing chamber therein;

an inlet tangentially attached to said housing for introducing a solids and fluid mixture into said chamber;

impactors arranged in clusters within said cylindrical chamber, a plurality of said clusters being disposed in spaced relation about an outer peripheral portion of said reducing chamber; and an outlet tube disposed centrally of said reducing chamber and extending axially out of said housing for providing an exit for a combined solids and fluid mixture, wherein a radially inner portion of said reducing chamber surrounding said outlet tube is free from obstruction, said apparatus further including a liner having a bottom portion removably overlaying a bottom of said housing, said clusters being fixedly attached to said liner bottom portion, said clusters and liner bottom portion being easily removed for allowing replacement thereof, and further wherein the impactors in each cluster are arranged in a plurality of rows, said rows being spaced circumferentially about said chamber and adjacent circumferentially spaced rows being offset by a distance substantially equivalent to one-half of the distance between adjacent impactors of any given row.

8. The apparatus of claim 7 and further including an adjustment means for making said outlet tube axially movable in said housing for providing an outlet capable of assuming various heights.

* * * * *